US011085306B2

(12) United States Patent
Lee et al.

(10) Patent No.: US 11,085,306 B2
(45) Date of Patent: Aug. 10, 2021

(54) TURBINE ROTOR BLADE WITH AIRFOIL COOLING INTEGRATED WITH IMPINGEMENT PLATFORM COOLING

(71) Applicant: Siemens Aktiengesellschaft, Munich (DE)

(72) Inventors: Ching-Pang Lee, Cincinnati, OH (US); Anthony Waywood, Cincinnati, OH (US); Steven Koester, Toledo, OH (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 45 days.

(21) Appl. No.: 16/497,163

(22) PCT Filed: Mar. 20, 2018

(86) PCT No.: PCT/US2018/023221

§ 371 (c)(1),
(2) Date: Sep. 24, 2019

(87) PCT Pub. No.: WO2018/208370

PCT Pub. Date: Nov. 15, 2018

(65) Prior Publication Data

US 2020/0095869 A1 Mar. 26, 2020

Related U.S. Application Data

(60) Provisional application No. 62/478,296, filed on Mar. 29, 2017.

(51) Int. Cl.
*F01D 5/18* (2006.01)

(52) U.S. Cl.
CPC ..... *F01D 5/187* (2013.01); *F05D 2240/81* (2013.01); *F05D 2250/314* (2013.01);
(Continued)

(58) Field of Classification Search
CPC ..... F05D 2240/81; F05D 2250/185; F05D 2260/20; F05D 2260/201; F05D 2260/202;
(Continued)

(56) References Cited

U.S. PATENT DOCUMENTS 8,133,024 B1 * 3/2012 Liang ..... F01D 5/187 416/1
8,491,263 B1 7/2013 Liang
(Continued)

FOREIGN PATENT DOCUMENTS

EP 2037081 A1 3/2009
EP 2589749 A2 5/2013
(Continued)

OTHER PUBLICATIONS

PCT International Search Report and Written Opinion dated Dec. 4, 2018 corresponding to PCT Application No. PCT/US2018/023221 filed Mar. 20, 2018.

*Primary Examiner* — Mark A Laurenzi
*Assistant Examiner* — Mickey H France

(57) ABSTRACT

An integrated airfoil and platform cooling system (30) for a turbine rotor blade (10) includes an inlet (38, 48) located at the root (24) for receiving a supply of a coolant (K), and at least one cooling leg (32*a*, 32*c*, 42*a*, 42*c*) fluidly connected to the inlet (38, 48) and configured for conducting the coolant (K) in a radially outboard direction. The cooling leg (32*a*, 32*c*, 42*a*, 42*c*) is defined at least partially by a span-wise extending internal cavity (26) within a blade airfoil (12). An entrance of the cooling leg (32*a*, 32*c*, 42*a*, 42*c*) comprises a flow passage (92, 102) that extends radially outboard and laterally into a blade platform (50), so as to direct a radially outboard flowing coolant (K) to impinge on an inner side (60) of a radially outer surface (52) of the blade
(Continued)

platform (50), before leading the coolant (K) into the cooling leg (32*a,* 32*c,* 42*a,* 42*c*).

11 Claims, 4 Drawing Sheets

(52) U.S. Cl.
CPC ..... *F05D 2260/201* (2013.01); *F05D 2260/22141* (2013.01)

(58) Field of Classification Search
CPC ... F05D 2260/2212; F05D 2260/22141; F01D 5/18; F01D 5/186–189
USPC ..... 415/115, 97 R, 97 A
See application file for complete search history.

(56) References Cited

U.S. PATENT DOCUMENTS

| | | | | |
|---|---|---|---|---|
| 2007/0020100 | A1 | 1/2007 | Beeck et al. | |
| 2012/0014810 | A1 | 1/2012 | Antunes et al. | |
| 2012/0269615 | A1 | 10/2012 | Kuwabara | |
| 2013/0115059 | A1* | 5/2013 | Walunj | F01D 5/187 415/176 |
| 2014/0338364 | A1 | 11/2014 | Johns et al. | |

FOREIGN PATENT DOCUMENTS

| | | | |
|---|---|---|---|
| WO | 2014130244 | A1 | 8/2014 |
| WO | 2016122478 | A1 | 8/2016 |

* cited by examiner

VIEW IV-IV

VIEW II-II

VIEW III-III

TURBINE ROTOR BLADE WITH AIRFOIL COOLING INTEGRATED WITH IMPINGEMENT PLATFORM COOLING

BACKGROUND

1. Field

The present invention is relates to turbine rotor blades, and in particular, to turbine rotor blades with integrated airfoil and platform cooling.

2. Description of the Related Art

Typically, a gas turbine engine includes a compressor section for compressing air, a combustor section for mixing the compressed air with fuel and igniting the mixture to form a hot working fluid, and a turbine section for producing power from the hot working fluid. A turbine section is usually provided with multiple rows or stages of turbine rotor blades that expand the hot working fluid to produce mechanical power. The efficiency of a gas turbine engine can be increased by passing a higher temperature gas flow into the turbine section. As a result, turbine rotor blades must be made of materials capable of withstanding such high temperatures. In addition, turbine rotor blades often contain cooling systems for prolonging the life of the blades and reducing the likelihood of failure as a result of excessive temperatures.

Typically, turbine rotor blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine rotor blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine rotor blade at a relatively uniform temperature. However, centrifugal forces and air flow at boundary layers often prevent some areas of the turbine rotor blade from being adequately cooled, which results in the formation of localized hot spots. Localized hot spots, depending on their location, can reduce the useful life of a turbine rotor blade and can damage a turbine rotor blade to an extent necessitating replacement of the blade.

Blade platforms often include cooling passageways drawing cooling air from the cavity under the platform. These cooling passages are typically interconnected to provide cooling coverage. However, the forward rotor cooling cavity can be subject to hot gas ingestion, which results in much warmer air under the blade platform and negatively impacts the platform cooling. Thus, a need exists for a turbine rotor blade with an improved cooling system that overcomes these shortcomings.

SUMMARY

Briefly, aspects of the present invention relate to a turbine rotor blade with airfoil cooling integrated with impingement platform cooling.

According to a first aspect of the invention, a turbine rotor blade is provided. The blade includes a platform, an airfoil extending span-wise radially outward from the platform and a root extending radially inward from the platform for mounting the turbine rotor blade to a disc. The blade further comprises an integrated airfoil and platform cooling system. The cooling system comprises an inlet located at the root for receiving a supply of a coolant and at least one cooling leg fluidly connected to the inlet and configured for conducting the coolant in a radially outboard direction. The cooling leg is defined at least partially by a span-wise extending internal cavity within the airfoil. An entrance of said cooling leg comprises a flow passage that extends radially outboard and laterally into the platform, so as to direct a radially outboard flowing coolant to impinge on an inner side of a radially outer surface of the platform, before leading the coolant into said cooling leg.

According a second aspect of the invention, a turbine rotor blade is provided. The blade includes a platform, an airfoil extending span-wise radially outward from the platform, and a root extending radially inward from the platform for mounting the blade to a disc. The airfoil comprises a pressure side and a suction side joined at a leading edge and at a trailing edge. The airfoil is generally hollow comprising therewithin a plurality of internal cavities. The blade further comprises an integrated airfoil and platform cooling system, comprising at least one serpentine channel. The at least one serpentine channel comprises at least a first leg and a second leg fluidly connected by a flow turn. The first and second legs conduct a coolant in generally radially inboard and radially outboard directions respectively. The first and second legs are defined at least partially within the airfoil by a first and a second of said plurality of internal cavities respectively. The flow turn is located radially inboard of the platform. Downstream of the flow turn, the serpentine channel comprises a passage that extends radially outboard and laterally into the platform, so as to direct a radially outboard flowing coolant to impinge on an inner side of a radially outer surface of the platform.

According to a third aspect of the invention, a turbine rotor blade is provided. The blade comprises a platform, an airfoil extending span-wise radially outward from the platform, and a root extending radially inward from the platform for mounting the blade to a disc. The airfoil comprises a pressure side and a suction side joined at a leading edge and at a trailing edge. The blade further comprises an integrated airfoil and platform cooling system, which includes a first serpentine channel and a second serpentine channel. The first serpentine channel extends chord-wise in an aft-to-forward direction toward the leading edge of the airfoil. The second serpentine channel extends chord-wise in a forward-to-aft direction toward the trailing edge of the airfoil. Each of the first and second serpentine channels comprises a plurality of legs which are located at least partially within the airfoil. Serially adjacent legs of each serpentine channel conduct a coolant in alternating radial directions and are fluidly connected by a respective flow turn defined by a tip turn or a root turn. Each root turn of the first serpentine channel and the second serpentine channel is located radially inboard of the platform. Downstream of each root turn, the respective serpentine channel comprises a respective flow passage that extends radially outboard and laterally into the platform, so as to direct a radially outboard flowing coolant to impinge on an inner side of a radially outer surface of the platform.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the this disclosure, the direction A denotes an axial direction parallel to a rotation axis 8, while the directions R and C respectively denote a radial direction and a circumferential direction with respect to the rotation axis 8.

Figure 1:
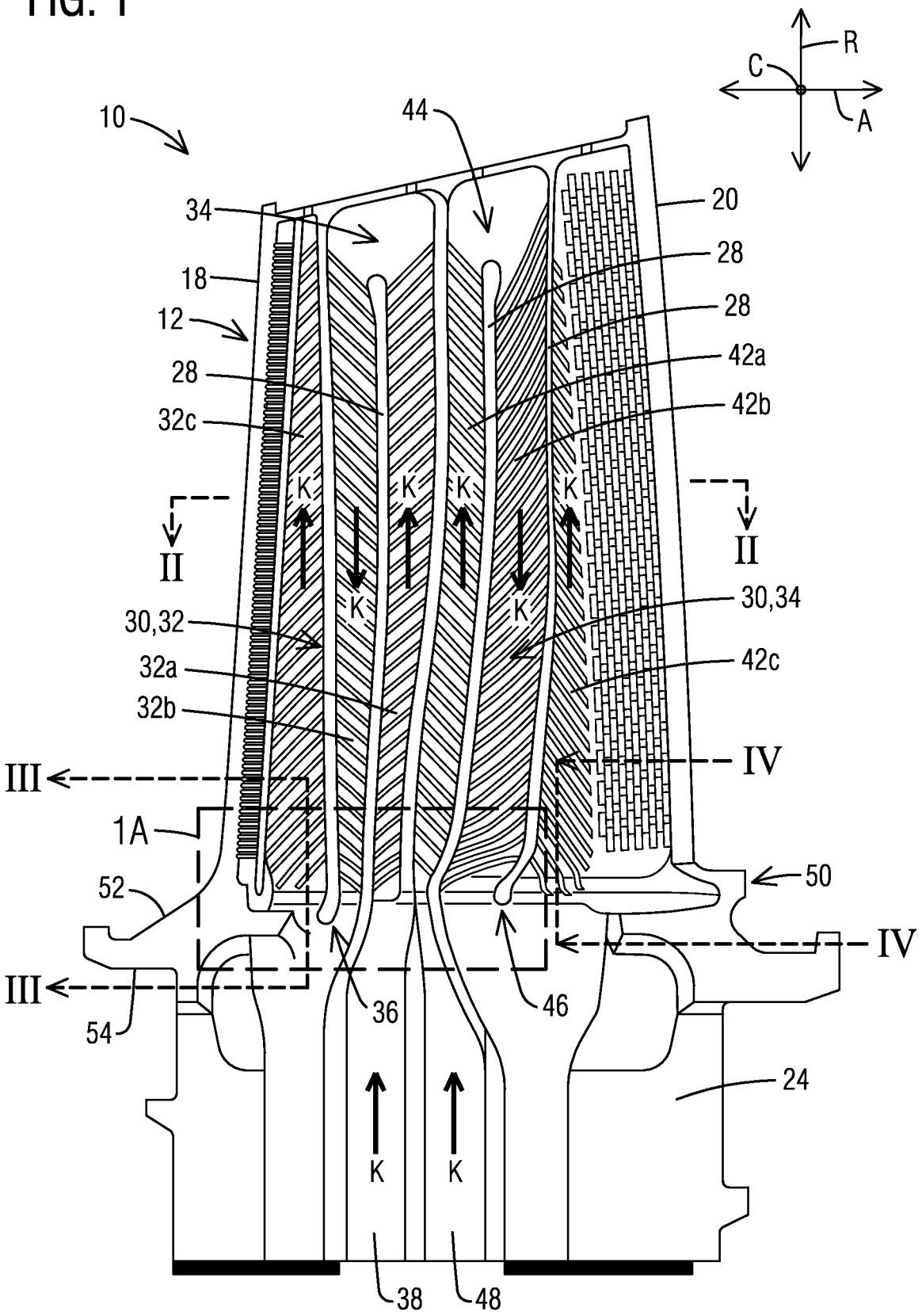
FIG. 1 is a longitudinal sectional view of a turbine rotor blade looking from the pressure side to the suction side, illustrating an integrated airfoil and platform cooling system in accordance with one embodiment of the invention.
Figure 2:
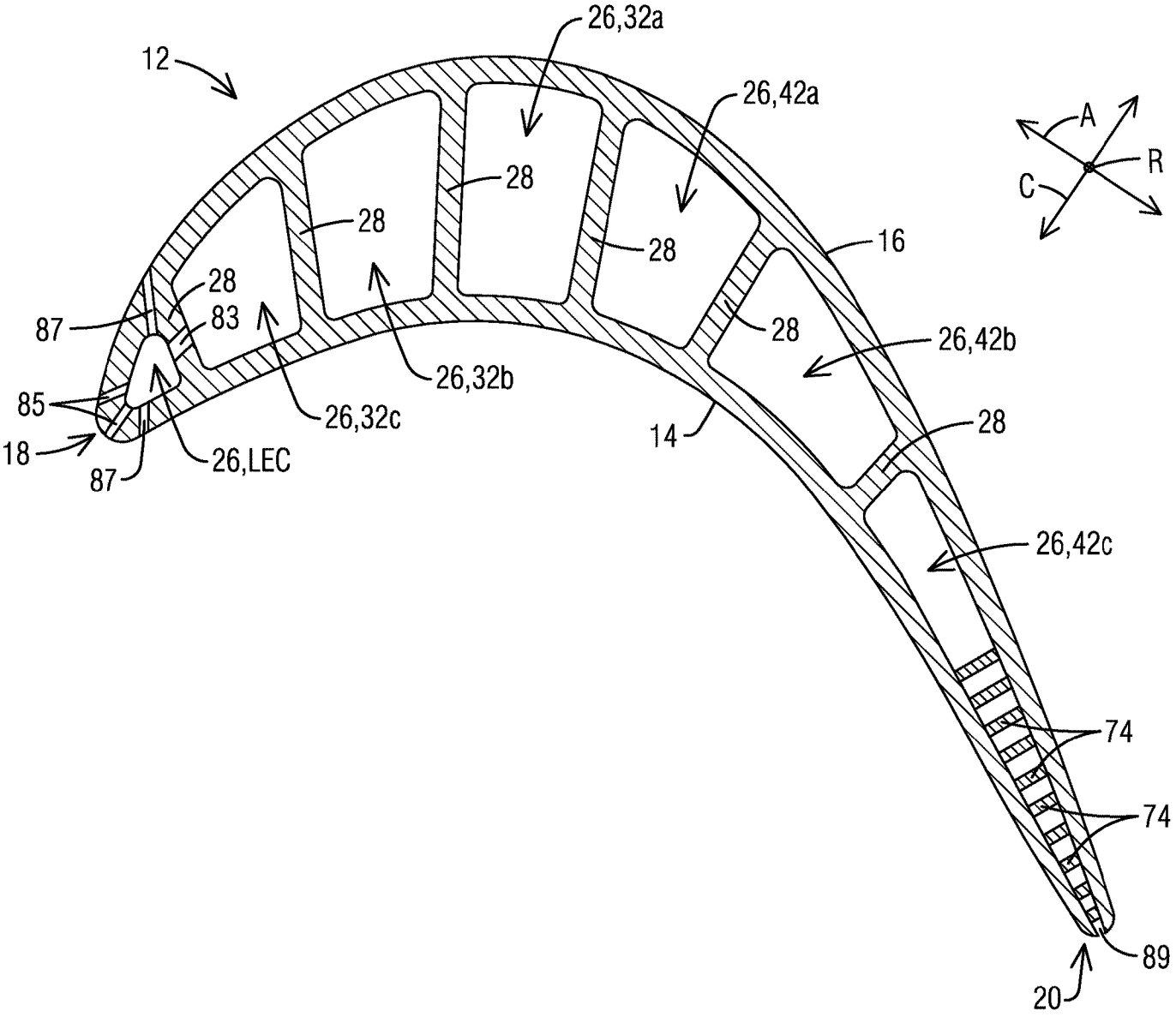
FIG. 2 is a cross-sectional view of the turbine rotor blade, looking radially inward along the section II-II of FIG. 1.

FIG. 1 illustrates a turbine rotor blade 10 according to an example embodiment of the invention. The blade 10 is rotatable about a longitudinal rotor axis 8 of a turbine section of a gas turbine engine. The blade 10 comprises an airfoil 12 that extends span-wise radially outward from a platform 50 into a flow path of a hot working fluid. As best illustrated in FIG. 2, the airfoil 12 may include a generally concave pressure side 14 and a generally convex suction side 16, which are joined at a leading edge 18 and at a trailing edge 20. The airfoil 12 is generally hollow and comprises a plurality of span-wise extending internal cavities 26. The cavities 26 may serve as internal cooling channels, being separated by span-wise extending partition ribs 28. Referring back to FIG. 1, the platform 50 comprises a radially outer surface 52 exposed to the hot working fluid, and a radially inner surface 54 opposite to the radially outer surface 52. The blade 10 further comprises root 24 that extends radially inward from the radially inner surface 54 of the platform 50. The root 24 is typically fir-tree shaped, and is configured to fit into a correspondingly shaped slot in the rotor disc (not shown). Multiple such blades 10 may be mounted on to the rotor disc in a circumferential array, to form a row of turbine rotor blades.

The blade 10 is provided with a cooling system 30, which may utilize a coolant such as air diverted from a compressor section of the turbine engine, for cooling the blade components that are exposed to the hot working fluid during engine operation. To improve engine efficiency, it is desirable to minimize the overall coolant flow requirement. In the illustrated embodiment, the cooling system 30 provides an efficient cooling mechanism by integrating airfoil cooling with platform cooling in a way that the coolant flow circulating in the airfoil 12 is utilized for cooling of the platform 50. Use of additional coolant for cooling the platform separately may be thereby obviated. In particular, embodiments of the present invention provide a mechanism for effecting an impingement cooling on an inner side 60 of the radially outer surface 52 of the platform 50 (see FIGS. 3 and 4), utilizing coolant circulating in an airfoil serpentine cooling circuit.

In the illustrated example, the cooling system 30 comprises a forward cooling circuit and an aft cooling circuit. The forward cooling circuit incorporates a first serpentine channel 32 extending chord-wise in an aft-to-forward direction. The first serpentine channel 32 thus extends chord-wise toward the leading edge 18 of the airfoil 12 from a mid-chord portion of the blade 10. The aft cooling circuit incorporates a second serpentine channel 42 extending chord-wise in a forward-to-aft direction. The second serpentine channel 42 thus extends chord-wise toward the trailing edge 20 of the airfoil 12 from a mid-chord portion of the blade 10.

In this example, as shown in FIG. 1, the first serpentine channel 32 forms a 3-pass serpentine circuit comprising span-wise extending cooling legs 32*a*, 32*b* and 32*c*. The legs 32*a*, 32*b*, 32*c* are formed at least partially within the airfoil 12, being defined by adjacent internal cavities 26 separated by partition ribs 28 (see FIG. 2). The legs 32*a*, 32*b*, 32*c* are fluidly connected in series and conduct a coolant K in alternating radial directions. The leg 32*a* is connected to a coolant inlet 38 located at the root 24 which receives a cooling air supply, for example, from a compressor section of the turbine engine. The leg 32*a* conducts the coolant K in a radially outboard direction and is connected to the leg 32*b* via a flow turn 34. The leg 32*b* then conducts the coolant K in a radially inboard direction and is connected via a flow turn 36 to the leg 32*c*, which then conducts the coolant K in a radially outboard direction. The cavities 26 defining the legs 32*a*, 32*b*, 32*c* may be provided with internal wall features such as turbulators 70 for enhancing heat transfer with the coolant K. As shown in FIG. 2, from the leg 32*c*, the coolant K may enter a leading edge cavity LEC via cross-over holes 83 formed on an intervening partition rib 28. From the leading edge cavity LEC, the coolant is discharged from the airfoil 12 via showerhead openings 85 at the leading edge 18 and/or film cooling holes 87 on one or both of the sidewalls 14, 16 of the airfoil 12.

Referring back to FIG. 1, in the illustrated example, the second serpentine channel 42 also forms a 3-pass serpentine circuit comprising span-wise extending cooling legs 42*a*, 42*b* and 42*c*. The legs 42*a*, 42*b*, 42*c* are formed at least partially within the airfoil 12, being defined by adjacent internal cavities 26 separated by partition ribs 28 (see FIG. 2). The legs 42*a*, 42*b*, 42*c* are fluidly connected in series and conduct a coolant K in alternating radial directions. The leg 42*a* is connected to a coolant inlet 48 located at the root 24, which receives a cooling air supply, for example, from a compressor section of the turbine engine. The leg 42*a* conducts the coolant K in a radially outboard direction and is connected to the leg 42*b* via a flow turn 44. The leg 42*b* then conducts the coolant K in a radially inboard direction and is connected via a flow turn 46 to the leg 42*c*, which then conducts the coolant in a radially outboard direction. The cavities 26 defining the legs 42*a*, 42*b*, 42*c* may be provided with internal wall features such as turbulators 70 for enhancing heat transfer with the coolant K. As shown in FIG. 2, the leg 42*c* may be connected to trailing edge cooling features 74, such as pin fins, leading up to exit slots 89 located at the trailing edge 20 through which the coolant is discharged from the airfoil 12.

In this description, each of the flow turns 34, 44, which turns the coolant flow generally from a radially outboard direction to a radially inboard direction is referred to as a "tip turn". On the other hand, each of the flow turns 36, 46, which turns the coolant flow generally from a radially inboard direction to a radially outboard direction is referred to as a "root turn". In accordance with the illustrated embodiments, at least one, but preferably each of the root turns 36, 46 of the cooling system 30 is located radially inboard of the platform 50, so as to turn the coolant radially outboard to impinge on the inner side 60 of the radially outer surface 52 of the platform 50.

Figure 1A:
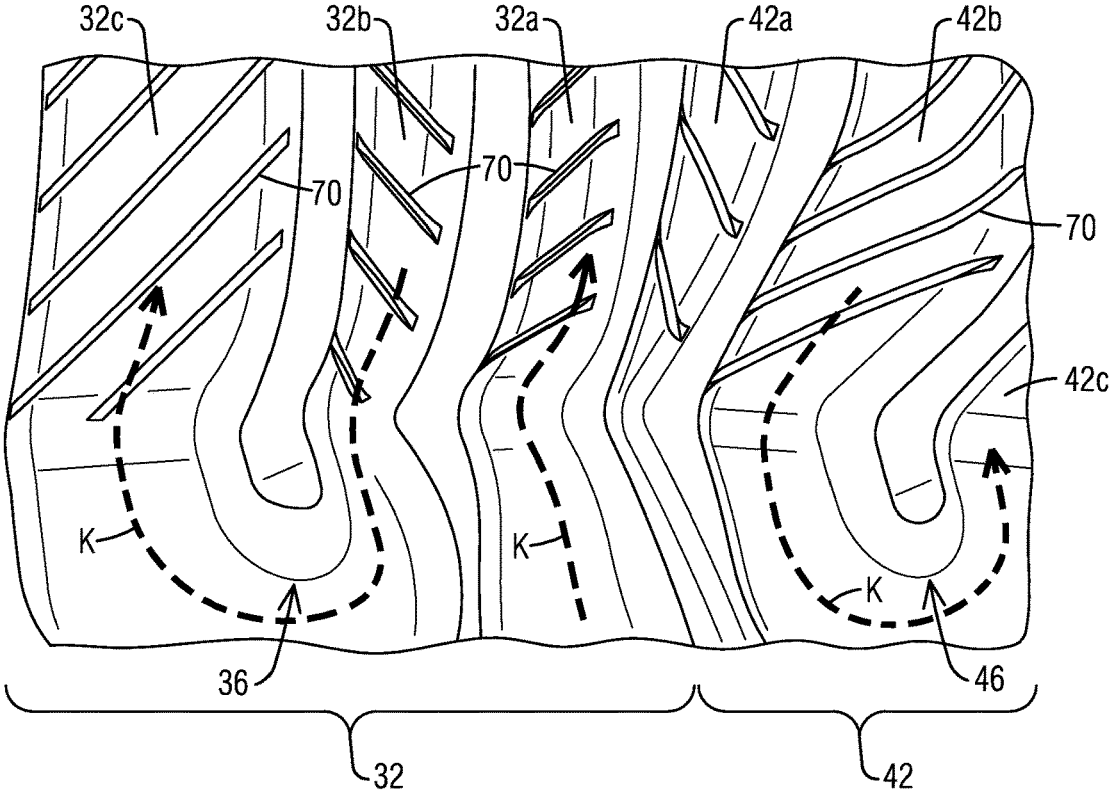
FIG. 1A is an enlarged depiction of the portion 1A in FIG. 1.
Figure 3:
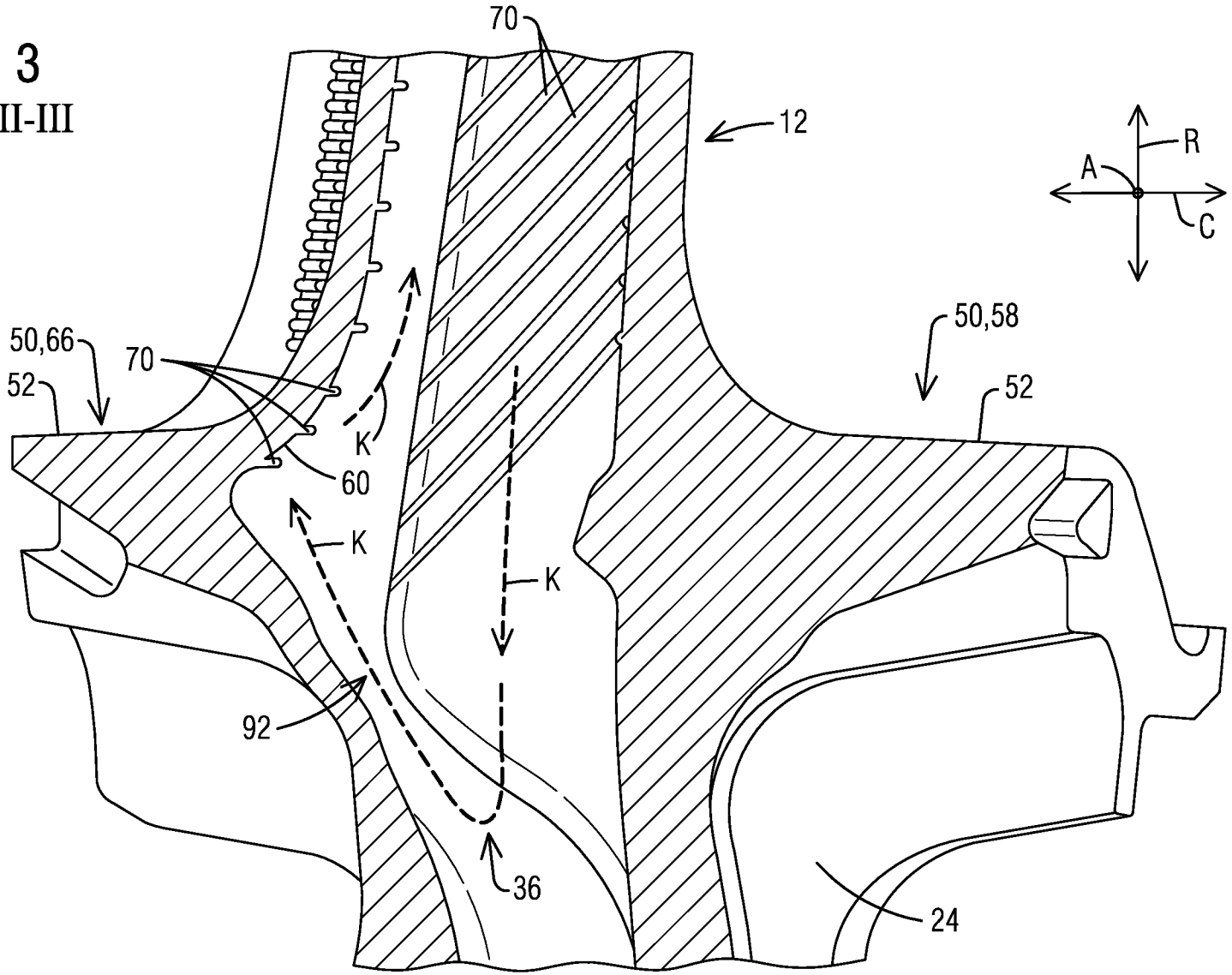
FIG. 3 is a cross-sectional view of the turbine rotor blade, looking chord-wise aft to forward along the section of FIG. 1.

Referring now to FIGS. 1, 1A and 3, the arrangement of the root turn 36 of the forward serpentine channel 32 of the present example is illustrated. As shown, the root turn 36 is located radially inboard of the platform 50. At an entrance of the cooling leg 32*c* downstream of the root turn 36, the serpentine channel 32 comprises a flow passage 92 that extends radially outboard, and also laterally into the platform 50 by a distance outside silhouette of the airfoil 12 defined by the pressure side 14, suction side 16, leading edge 18 and trailing edge 20. The radially outboard and lateral extension of the flow passage 92 downstream of the root turn 36 directs a radially outboard flowing coolant K to impinge on an inner side 60 of a radially outer surface 52 of the platform 50. The impingement of the coolant K on the inner side 60 provides improved backside cooling of the radially outer surface 52 of the platform 50, which is exposed to the hot working fluid. In a preferred embodiment, to enhance impingement cooling of the platform 50, the inner side 60 of the radially outer surface 52 of the platform 50 may be provided with turbulators 70 in an impingement region defined within the lateral extension of the flow passage 92 into the platform 50. As shown in FIG. 3, in the forward cooling circuit of the present embodiment, the post impingement coolant K flows entirely into the leg 32*c* of the serpentine channel 32 extending into the airfoil 12.

Figure 4:
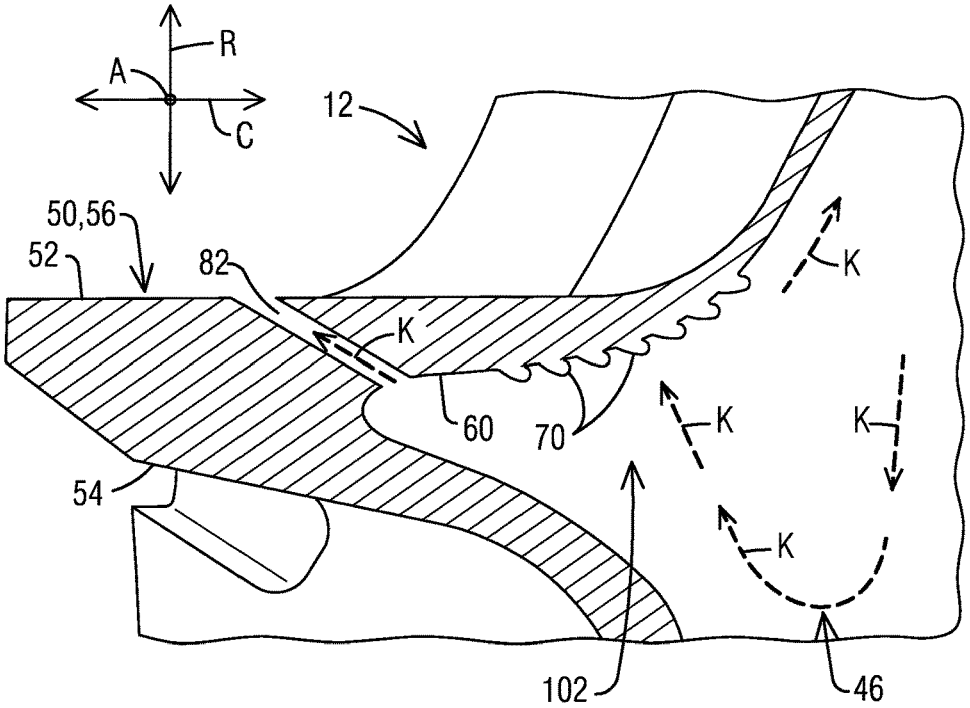
FIG. 4 is a cross-sectional view of the turbine rotor blade, looking chord-wise aft to forward along the section IV-IV of FIG. 1.

Referring now to FIGS. 1, 1A and 4, the arrangement of the root turn 46 of the aft serpentine channel 42 of the present example is illustrated. As shown, the root turn 46 is located radially inboard of the platform 50. At an entrance of the cooling leg 42*c* downstream of the root turn 46, the serpentine channel 42 comprises a flow passage 102 that extends radially outboard, and also laterally into the platform 50 by a distance outside silhouette of the airfoil 12 defined by the pressure side 14, suction side 16, leading edge 18 and trailing edge 20. The radially outboard and lateral extension of the flow passage 102 downstream of the root turn 46 directs a radially outboard flowing coolant K to impinge on an inner side 60 of a radially outer surface 52 of the platform 50. The impingement of the coolant K on the side 60 provides improved backside cooling of the radially outer surface 52 of the platform 50, which is exposed to the hot working fluid. In a preferred embodiment, to enhance the impingement cooling of the platform 50, the inner side 60 of the radially outer surface 52 of the platform 50 comprises turbulators 70 in an impingement region defined within the lateral extension the flow passage 102 into the platform 50. Furthermore, to better utilize the post serpentine cooling air of the aft cooling circuit, film cooling holes 82 are provided on the aft portion of the platform. The film cooling holes 82 are formed on the radially outer surface 52 of the platform 50, with each film cooling hole 82 fluidly connecting the radially outer surface 52 of the platform 50 to the lateral extension of the flow passage 102 of the aft serpentine channel 42 into the platform 50. Thus, a portion of the post impingement coolant K of the aft serpentine channel 42 is exhausted through the film cooling holes 82, while the rest of the coolant K flows into the cooling leg 42*c* extending into the airfoil 12. Although not shown in the drawings, film cooling holes can be connected to any location of the laterally extending flow passages in the platform. For example, in addition to or alternate to what is shown in the drawings, film cooling holes may be provided on the forward portion of the platform 50, which fluidly connect the radially outer surface 52 of the platform 50 to the lateral extension of the flow passage 92 of the forward serpentine channel 32 into the platform 50.

As shown in FIGS. 3 and 4, the platform 50 may be considered to comprise of a pressure side platform portion 56 adjacent to the pressure side 14 of the airfoil 12, and a suction side platform portion 58 adjacent to the suction side 16 of the airfoil 12. In the illustrated example, the lateral extension of the flow passages 92, 102 of both the serpentine channels 32, 42 is provided into the pressure side platform portion 56. Additionally or alternately, the lateral extension of the flow passages 92, 102 of one or both of the serpentine channels 32, 42 may be provided on the suction side platform portion 58. Furthermore, as shown in FIGS. 3 and 4, in the example embodiment, the lateral extension of the flow passage 102 of the aft serpentine channel 42 into the platform 50 may be greater than the lateral extension of the flow passage 92 of the forward serpentine channel 32 into the platform 50.

Furthermore, alternate to or in addition to the above illustrated embodiments, the platform impingement also can be provided at the entrance of the cooling legs 32*a*, 42*a* of one or both the serpentine channels 32, 42. To this end, an entrance of the cooling leg 32*a*, 42*a* may comprise a flow passage (not shown) that may extend radially outboard and laterally into the platform 50, so as to direct a radially outboard flowing coolant K from the inlet 38, 48 to impinge on an inner side 60 of a radially outer surface 52 of the platform 50, before leading the coolant K into the cooling leg 32*a*, 42*a*.

The illustrated embodiments present a number of benefits. First, by integrating airfoil and platform cooling, an efficient usage of the coolant may be established, which is beneficial in lowering coolant flow requirements in high efficiency turbine engines. Moreover, by providing a root turn of the airfoil serpentine cooling circuit below the platform, an additional impingement cooling of the platform is realized. Positioning the root turn below the level of the platform (i.e., at a relatively cold location) may also reduce local stresses.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine rotor blade comprising:

a platform, an airfoil extending span-wise radially outward from the platform, and comprising a pressure side and a suction side joined at a leading edge and at a trailing edge, the airfoil being generally hollow comprising therewithin a plurality of internal cavities, a root extending radially inward from the platform for mounting the turbine rotor blade to a disc, and an integrated airfoil and platform cooling system, comprising:

at least one serpentine channel, comprising at least a first leg and a second leg fluidly connected by a flow turn, wherein the first leg and the second leg conduct a coolant in generally radially inboard and radially outboard directions respectively, the first leg and the second leg being defined at least partially within the airfoil by a first and a second of said plurality of internal cavities respectively, wherein the flow turn is located radially inboard of the platform, and wherein downstream of the flow turn, the serpentine channel comprises a flow passage that extends radially outboard and laterally into the platform, so as to direct a radially outboard flowing coolant to impinge on an inner side of a radially outer surface of the platform, wherein the inner side of the radially outer surface of the platform comprises turbulators in an impingement region defined within the lateral extension of the flow passage into the platform.

2. The turbine rotor blade according to claim 1, wherein post impingement, the coolant flows entirely into the second leg of the serpentine channel extending into the airfoil.

3. The turbine rotor blade according to claim 1, further comprising a plurality of film cooling holes formed on the radially outer surface of the platform, the film cooling holes fluidly connecting the radially outer surface of the platform to the lateral extension of the flow passage into the platform.

4. The turbine rotor blade according to claim 1, wherein the lateral extension of the flow passage is provided only into a pressure side platform portion.

5. The turbine rotor blade according to claim 1, wherein the at least one serpentine channel extends chord-wise in an aft-to-forward direction from a mid-chord portion of the blade to the leading edge of the airfoil.

6. The turbine rotor blade according to claim 1, wherein the at least one serpentine channel extends chord-wise in a forward-to-aft direction from a mid-chord portion of the blade to the trailing edge of the airfoil.

7. A turbine rotor blade comprising:

a platform, an airfoil extending span-wise radially outward from the platform, and comprising a pressure side and a suction side joined at a leading edge and at a trailing edge, a root extending radially inward from the platform for mounting the turbine rotor blade to a disc, and an integrated airfoil and platform cooling system, comprising:

a first serpentine channel extending chord-wise in an aft-to-forward direction toward the leading edge of the airfoil, a second serpentine channel extending chord-wise in a forward-to-aft direction toward the trailing edge of the airfoil, wherein each of the first and second serpentine channels comprise a plurality of legs which are located at least partially within the airfoil, wherein serially adjacent legs of each serpentine channel conduct a coolant in alternating radial directions and are fluidly connected by a respective flow turn defined by a tip turn or a root turn, wherein each root turn of the first serpentine channel and the second serpentine channel is located radially inboard of the platform, and wherein downstream of each root turn, the respective serpentine channel comprises a respective flow passage that extends radially outboard and laterally into the platform, so as to direct a radially outboard flowing coolant to impinge on an inner side of a radially outer surface of the platform, wherein the inner side of the radially outer surface of the platform comprises turbulators in an impingement region defined within the lateral extension of one or both of the flow passages into the platform.

8. The turbine rotor blade according to claim 7, further comprising a plurality of film cooling holes formed on the radially outer surface of the platform, each film cooling hole fluidly connecting the radially outer surface of the platform to the lateral extension of a flow passage into the platform.

9. The turbine rotor blade according to claim 8, wherein the film cooling holes are provided only at an aft portion of the platform, connecting the radially outer surface of the platform to the lateral extension of the flow passage of the second serpentine channel into the platform.

10. The turbine rotor blade according to claim 7, wherein the lateral extension of the each flow passage is provided only into a pressure side platform portion.

11. The turbine rotor blade according to claim 7, wherein the lateral extension of the flow passage of the second serpentine channel into the platform is greater than the lateral extension of the flow passage of the first serpentine channel into the platform.

* * * * *